US007745011B2

(12) United States Patent
Cantu-Gonzalez

(10) Patent No.: US 7,745,011 B2
(45) Date of Patent: Jun. 29, 2010

(54) COATING COMPOSITION AND METHOD FOR ENHANCING THE STRENGTH OF CORRUGATED CARDBOARD

(75) Inventor: Carlos Cantu-Gonzalez, Nuevo Leon (MX)

(73) Assignee: Ingenieros Consultores Asociados, S.A., Monterrey (MX)

( * ) Notice: Subject to any disclaimer, the term of this patent is extended or adjusted under 35 U.S.C. 154(b) by 186 days.

(21) Appl. No.: 11/366,780

(22) Filed: Mar. 1, 2006

(65) Prior Publication Data

US 2007/0208125 A1 Sep. 6, 2007

(51) Int. Cl.
*B32B 29/08* (2006.01)
*B32B 25/14* (2006.01)
*B32B 27/10* (2006.01)
*B32B 27/28* (2006.01)

(52) U.S. Cl. ..... 428/453; 428/485; 428/486; 428/511; 428/512; 524/492; 524/847; 524/487; 524/575

(58) Field of Classification Search ..... 524/575, 524/442, 492, 487, 515, 847; 428/486, 807, 428/509, 182, 484, 485, 512, 511, 688, 908.8, 428/453; 427/385.5, 387, 391, 416, 419.2; 162/181.7
See application file for complete search history.

(56) References Cited

U.S. PATENT DOCUMENTS

| | | | | | |
|---|---|---|---|---|---|
| 1,365,715 | A | * | 1/1921 | Morrison | 106/614 |
| 1,592,294 | A | * | 7/1926 | Clapp | 162/172 |
| 1,739,580 | A | * | 12/1929 | Ellis | 162/172 |
| 1,762,928 | A | * | 6/1930 | Manson | 162/172 |
| 1,762,929 | A | * | 6/1930 | Manson | 162/172 |
| 1,762,930 | A | * | 6/1930 | Manson | 162/172 |
| 1,842,112 | A | * | 1/1932 | Pearson | 162/172 |
| 1,894,567 | A | * | 1/1933 | Manson | 162/172 |
| 1,895,527 | A | * | 1/1933 | Swan | 428/449 |
| 1,953,085 | A | * | 4/1934 | Manson | 106/622 |
| 1,957,370 | A | * | 5/1934 | Thomas et al. | 428/448 |
| 3,085,026 | A | | 4/1963 | Weisgerber et al. | 117/60 |
| 3,260,690 | A | | 7/1966 | Bohnert et al. | 260/29.7 |
| 3,308,006 | A | * | 3/1967 | Kresse et al. | 428/186 |
| 3,469,977 | A | * | 9/1969 | Savage | 430/63 |
| 3,985,937 | A | * | 10/1976 | Fife | 428/486 |
| 4,117,199 | A | * | 9/1978 | Gotoh et al. | 428/486 |
| 5,332,458 | A | | 7/1994 | Wallick | 156/210 |
| 5,626,945 | A | | 5/1997 | Berzins et al. | 428/174 |
| 5,635,279 | A | | 6/1997 | Ma et al. | 428/174 |
| 5,658,971 | A | | 8/1997 | Allin et al. | 524/28 |
| 5,750,237 | A | * | 5/1998 | Allin et al. | 428/182 |
| 5,869,192 | A | | 2/1999 | Allin et al. | 428/511 |
| 6,030,673 | A | | 2/2000 | Andersen et al. | 428/36.4 |
| 6,066,379 | A | * | 5/2000 | Ma et al. | 428/53 |
| 6,143,113 | A | | 11/2000 | Berube | 156/210 |
| 6,429,240 | B1 | | 8/2002 | Michelman et al. | 524/13 |
| 6,541,556 | B1 | | 4/2003 | Berube | 524/398 |
| 6,722,560 | B2 | | 4/2004 | Player et al. | 229/5.84 |
| 6,794,016 | B2 | | 9/2004 | Kumabe et al. | 428/182 |
| 6,878,199 | B2 | | 4/2005 | Bowden et al. | 106/162.5 |

OTHER PUBLICATIONS

Demidovich et al. SU 1479443 (May 15, 1989) abstract.*

* cited by examiner

*Primary Examiner*—David Wu
*Assistant Examiner*—Rip A. Lee
(74) *Attorney, Agent, or Firm*—Frommer Lawrence & Haug, LLP; A. Thomas S. Safford

(57) ABSTRACT

A low-cost and effective coating composition for cardboard allows use of thinner paper board with the same or higher strength relative to conventional water-resistant cardboard. The resulting cardboard can also be repulped and more easily recycled. The inventive coating composition, preferably applied to the fluted inner ply of the cardboard (as a waterproof barrier), is compatible with the utilization of low-cost starch-based adhesives for gluing the fluting to the liners. At least one side of the fluting cardboard is coated with a composition comprising: from about 10% to 70% by weight, and more preferably from about 40% to 60% by weight, of sodium silicate; from about 10% to 60% by weight, and more preferably from about 30% to about 50% by weight, of a synthetic resin emulsion; from about 10% to 50% of a paraffin-water emulsion; and from about 5% to about 25% by weight of added water.

14 Claims, No Drawings

COATING COMPOSITION AND METHOD FOR ENHANCING THE STRENGTH OF CORRUGATED CARDBOARD

FIELD OF THE INVENTION

The invention relates to a chemical composition and a method for enhancing the strength of corrugated cardboard having a principal application in the manufacturing of packing boxes.

BACKGROUND OF THE INVENTION

Corrugated cardboard has a variety of applications as packing material for many products. Corrugated cardboard is multi-walled. The most common corrugated board has three paper board walls. The two outside walls are usually called liners and the inner corrugated wall is commonly called the corrugated or fluted medium or just fluting.

One of the problems currently found in the industry, particularly in the trade involving products where the packing boxes made of corrugated cardboard have to withstand humid conditions, is that upon contact with water, the cardboard tends to absorb sufficient water to lose or significantly reduce its rigidity, whereby the boxes become ineffective for this intended use due to deformation and even eventual destruction.

In order to provide the corrugated cardboard with a waterproof quality, the liners, and sometimes the fluting, are currently coated with a variety of materials, mainly waxes and paraffins, thereby seeking relatively inexpensively to form a film of impermeable material (which retards the water from coming into contact with the underlying cardboard). A significant disadvantage in the standard use of paraffins arises from many problems encountered when used cardboard is recycled. Paraffin tends to form masses in the repulping vat which cannot be easily handled and must be separated.

It is also known that in order to provide stacking strength to packing boxes made of corrugated board, the liners and fluting are made of cardboard having a predetermined weight basis to provide the necessary strength, and additionally the flutes of the corrugated medium board in the box side walls are oriented in a vertical direction. When utilizing higher weight basis for the component materials, the vertical stacking strength will, within limits, be higher, but the cost also will be greater. It is therefore desirable to enhance the strength of the cardboard without increasing its weight basis.

Documents cited in this text, and all documents cited or referenced in the documents cited in this text, are incorporated herein by reference. Documents incorporated by reference into this text or any teachings therein may be used in the practice of this invention.

U.S. Pat. No. 3,085,026 discloses a wax composition for coating corrugated cartons and sheets thus producing stronger corrugated cardboard containers. The cardboard is impregnated with a composition containing at least 60% by weight of a refined crystalline paraffin wax and from 1 to 15% by weight of a polymer resin selected from the group of petroleum polymer resins and styrene polymer resins; said composition constituting from 26 to 37% of the total weight of the impregnated cardboard.

U.S. Pat. No. 3,260,690 discloses coated paper containers, such as drinking cups, milk cartons and the like for receiving various foods and beverages.

The coating composition comprises (a) a water emulsified styrene-butadiene copolymer alone, or (b) a water emulsified styrene-butadiene copolymer in admixture with water emulsified polystyrene. Polyacrylic resins and polyvinyl acetate may be added to improve the coating's resistance to the presence of oils.

U.S. Pat. No. 3,308,006 teaches a coating for a corrugated medium (fluting) comprising a wax-copolymer blend of a wax containing from about 25 to about 60 wt % ethylene-ethyl acrylate copolymer, ethylene vinyl acetate, butyl rubber, polyisobutilene, butadiene-styrene, and others, wherein the wax is selected from the group consisting of paraffin wax, microcrystalline wax and mixtures thereof.

U.S. Pat. No. 4,117,199 discloses a coated paper having a water-proof coating. The coating composition is an aqueous emulsion containing a synthetic rubber latex and a wax emulsion in an amount of the solid wax of 5 to 200 parts by weight per 100 parts by weight of the solid synthetic rubber.

U.S. Pat. No. 5,332,458 discloses a process for increasing the strength of corrugated cardboard applying a strength enhancing isocyanate resin to the fluted medium. This patent describes the general process of manufacturing a corrugated cardboard with an enhanced resistance.

U.S. Pat. No. 5,658,971 describes an aqueous coating composition comprising up to about 85% by weight of a latex of a styrene-butadiene copolymer, or a latex of a carboxylated styrene-butadiene copolymer, and a wax. The composition may also comprise sodium alginate and polyethylene.

U.S. Pat. No. 5,750,237 describes a double-faced liner board that is waterproof and which can be easily recyclable in contrast to cardboard waterproofed by wax. The top layer of the liner board is coated by a coating comprising an emulsion of a curable butadiene-styrene copolymer and $TiO_2$, the fluted medium layer is coated with an aqueous composition containing an emulsion of wax particles and a binder, preferably sodium alginate; and the bottom layer has a coating formed from an aqueous composition comprising about 10 to 85 wt % of a liquid curable styrene-butadiene copolymer and a wax.

U.S. Pat. No. 5,869,192 teaches an aqueous curable composition comprising a pre-polymer of a styrene-butadiene copolymer and $TiO_2$, forming a waterproof coating.

U.S. Pat. Nos. 5,635,279; 5,626,945 and 6,066,379 describe a water-repellant coating which includes a mixture of a polymer matrix and a pigment. The wax component may be paraffin or polyethylene wax. The polymer matrix may be polyethylene-butadiene polymer. The pigment is selected from the group consisting of aluminum trihydrate, barium sulfate, calcium carbonate, mica (potassium aluminum silicates), nepheline syenite (sodium potassium aluminosilicate), finely ground silica sand and other natural and synthetic types of silicates including talc (magnesium silicates), wollastonite (calcium metasilicates), bentonite (montmorillonite, smectite) and clay. A cardboard is described having a water repellant coating which includes a polymer matrix/wax mixture applied as an aqueous formulation. The coating composition consists essentially of a wax component selected from paraffin wax or polyethylene wax emulsions; a polymer matrix of polymer chains comprising a polystyrene-butadiene polymer copolymerized with a monomer having pendant carboxylic acid groups, which are cross-linked by a zinc ion.

U.S. Pat. No. 6,429,240 discloses a water-borne resin composition which can be readily applied to paper substrates and which provides enhanced strength and rigidity for the paper substrate. The coated paper is repulpable and recyclable. The coating composition comprising a water-borne resin selected from the group consisting of coal, tar, petroleum, turpentine feed stocks, and mixtures thereof; and a natural resin selected from the group consisting of resins, fossil resins, mined resins, secretion products from insects, and chemical derivatives and adducts of such natural resins.

U.S. Pat. Nos. 6,541,556 and 6,143,113 disclose a wax-free coating composition for corrugated cardboard comprising a styrene-acrylate copolymer and a $C_{14}$-$C_{18}$ fatty acid complex of a metal ion such as chromium.

U.S. Pat. No. 6,722,560 teaches a box of corrugated cardboard having a single moisture vapor barrier comprising a composition of polymers and ground-up mica.

U.S. Pat. No. 6,794,016 discloses a water-resistant corrugated fiberboard capable of being recycled after its use. A water-resistant layer is formed on at least one of the surfaces of the corrugated fiberboard by applying a coating containing a synthetic resin emulsion and a pigment. In a preferred embodiment of the invention of this publication, the synthetic resin emulsions are styrene/butadiene copolymer, styrene/acrylic copolymer and ethylene/vinyl acetate copolymer. A pigment may be added from the group consisting of precipitated calcium carbonate, calcium carbonate, heavy calcium carbonate, silica, clay, kaolin, talc, mica, sericite and aluminum hydroxide.

From all these, it can be seen that there is a continuing long-felt need in the corrugated box industry to find a truly low-cost and effective coating composition which adds strength to the cardboard, while being repulpable, and therefore contributing to an ecological recycling of used cardboard packings.

The invention also has application as a paper strengthener whereby for a given stacking resistance of corrugated packing boxes, the coating of the present invention allows for manufacturing said boxes utilizing a thinner paper than otherwise would be required to have such compression resistance. This provides an important economic advantage to the manufacturer of the packing boxes.

It is thus desirable to increase the strength of the corrugated board using the minimum weight basis of cardboard by enhancing the strength of at least one layer (i.e. ply) of the corrugated board.

OBJECTS OF THE INVENTION

It is then one object of the invention to provide a coating composition which can be applied to at least one side of the fluting of corrugated cardboard, which enhances the strength of the cardboard.

It is another object of the invention to provide a low-cost and effective coating composition which allows usage of a thinner paper board to achieve the same or higher strength of a corrugated box as compared with boxes made of thicker cardboard.

It is a further object of the invention to provide a coating composition for corrugated cardboard manufacture capable of being repulped and easily recyclable, with consequent and significant environmental and economical benefits.

It is another object of the invention to provide a coating composition which is applied to the fluting of a corrugated cardboard and which provides to said corrugated cardboard, and the shipping containers made therefrom, a waterproof barrier thus extending the use of the shipping containers in humid environments or the use thereof in contact with humid contents.

It is a further object of the invention to provide a waterproof coating composition which allows for the utilization of low-cost starch-based adhesives for gluing the fluting to the liners of a corrugated paper board.

The objects of the invention are generally achieved by coating at least one of the plies of a corrugated cardboard with a coating composition of the materials herein specified, for example in the following proportions:

from about 10% to 70% by weight, and more preferably from about 30% to 40% by weight, of sodium silicate;

from about 10% to 60% by weight, and more preferably from about 10% to about 20% by weight, of a latex resin emulsion;

from about 10% to 50% by weight, and more preferably from about 30% to about 40% by weight of a paraffin-water emulsion; and from about 5% to about 25% by weight of added water.

Water is added in suitable proportions so as to render the mixture fluid for its application in the corrugated cardboard process (this 5% to 25% range is in addition to water that is already present in the latex and paraffin emulsions).

DETAILED DESCRIPTION OF THE INVENTION

Preferred embodiments of the present invention will be described in connection with the manufacture of corrugated board packing boxes. Those skilled in the art will however realize that the invention may be also applied to other types of cardboard materials for rendering said material resistant to humidity and water contact and also for enhancing its strength without increasing its weight basis (as correlatively maintaining its strength while decreasing its weight basis).

The preferred composition of the water-proof coating comprises a water-based emulsion having from about 10% to 70% by weight, and more preferably from about 40% to 60% by weight, of sodium silicate;

from about 10% to 60% by weight, and more preferably from about 30% to about 50% by weight, of a latex resin emulsion;

from about 10% to 40% of a paraffin-water emulsion; and from about 5% to about 25% by weight of added water.

Still other preferred composition ranges are:

from about 40 to 50 wt % of a water-soluble sodium silicate;

from about 10 to 40 wt % of a latex resin emulsion;

from about 10 to 40 wt % of an aqueous emulsion of paraffin wax; and from about 5 to 25 wt % of added water.

or from about 30 to 40 wt % of a water-soluble sodium silicate;

from about 10 to 20 wt % of a latex resin emulsion;

from about 30 to 40 wt % of an aqueous emulsion of paraffin wax; and from about 5 to 25 wt % of added water.

or from about 25 to 35 wt % of a water-soluble sodium silicate;

from about 10 to 15 wt % of a latex resin emulsion;

from about 25 to 35 wt % of an aqueous emulsion of paraffin wax; and from about 20 to 40 wt % of added water.

The added water as specified in these ranges is in suitable proportions so as to render the mixture fluid for its application in the corrugated cardboard process.

It has been found by applicant that although some components of the above-referred coating composition have been used in the packing industry alone or in combination with other materials, the particular unique coating combination of the invention has provided an effective and low-cost solution to a present ongoing need for supplying water-resistant and stronger packing boxes while at the same time being competitive in the market.

The preferred type of sodium silicate for the invention is a liquid sodium silicate ($Na_2SiO_3.H_2O$) having an appearance of a viscous liquid, without color or odor and a density between about 1.39 and about 1.40 g/cm$^3$ It should be noted that sodium silicate, if used alone for paper coating, forms crystals and not a continuous film. Such crystals are dissolved easily in water, thus losing mechanical strength and resistance. The applicants have found that in uniquely combining the components of the composition according to the present invention there is a synergistic effect that results in a continuous and water resistant flexible film being formed that covers the paper board and while enhancing its strength.

The preferred type of latex resin emulsion for the invention is a water-based polymer or co-polymer and it may be cross-linked. The latex may also contain some curable agents.

The preferred paraffin wax emulsion is made from a natural wax (such as a petroleum wax); but an emulsion made from a synthetic paraffin wax, such as polyethylene, may also be used according to the invention in its broader aspects. Paraffin emulsions, particularly commercial paraffin wax emulsions, typically contain soaps. This fact renders the coating of the invention especially apt for repulping and recycling of the corrugated board; because, when the paraffin is contacted with water, the residual soap helps in forming again an emulsion and therefore the paraffin is easily separated from the paper fibers in the pulp. Such emulsions also typically contain about 40-60% solids.

The coating composition may also be supplemented with additives and other substances which will provide it with other desirable properties.

For example, the coating may contain thickeners, such as gelatins, gums, xanthan, and others, for obtaining desirable rheologic properties (viscosity) for a proper spreading over the paperboard by blades, rolls, aspersion or full impregnation. It may also contain pigments when a given color of the coating is desired. Other additives that may be added are antifoaming agents, biocides, catalyzers, film-forming agents, dispersants, anti-settling and coalescent agents, fillers, for example, silica, alumina, kaolin, starches. Also alcohols may be used in the composition to accelerate drying time since alcohols evaporate faster than water.

The coating of the invention is applied to the fluting (corrugated inner ply) of the cardboard on at least one of its sides in the proportion of from about 3 grams/m$^2$ to about 25 grams/m$^2$.

The coating may be applied in the corrugated board process before or after the corrugating step creating the fluted interior ply. Usually, it is necessary to apply this coating only on one side of the fluting. However, the coating may be applied to both sides of said fluting without departing from the spirit of the invention.

A significant economical and practical advantage of the herein claimed coating is that it allows utilization of a low-cost starch-based adhesive for gluing the fluting to the outer liner boards, therefore not requiring expensive adhesives or adhesives needing special handling due to the type of solvents involved.

Due to the above-mentioned characteristics of this coating, including that it is water-based, that it may be applied by the standard corrugated-board machinery, and that it allows for the use of low-cost widely-used adhesives, it solves with these added advantages a long-felt need in the industry.

Since the coating enhances the strength of cardboard and therefore the manufacturer may use paper boards having thinner walls with an overall lower weight basis for a given level of final strength of the packing boxes. The invention thus has lower ecological impact (by decreasing the amount of new wood pulp material needed), thus preserving trees and helping care of the environment. Also, the fact that this coating makes the final cardboard repulpable contributes to further reduce the ecological impact by allowing re-cycling of the cardboard and packing boxes.

Example 1

A surface of the fluting of three samples of corrugated cardboard for manufactured boxes was each coated respectively with two different coatings according to the present invention and, for comparison, with a traditional paraffin coating.

| | |
|---|---|
| Coating 1 composition (in weight percent): | |
| Sodium silicate | 31 |
| Styrene-butadiene latex resin emulsion | 12 |
| Paraffin-water emulsion | 31 |
| Water | 25.5 |
| Coating 2 composition (in weight percent): | |
| Sodium silicate | 27.9 |
| Styrene-butadiene latex resin emulsion | 11.3 |
| Paraffin-water emulsion | 27.9 |
| Water | 33.0 |

The results of the tests performed for the three specimens are shown in Table 1

| Test | Units | Paraffin Coating | Coating 1 | Coating 2 |
|---|---|---|---|---|
| Mullen | lb/sq inch | 170 | 163 | 155 |
| ECT | lb/sq inch | 108 | 108 | 126 |
| Thickness | Mils | 0.166 | 0.165 | 0.166 |
| COBB Exterior | grams of water | 30 | 30 | 30 |
| COBB Interior | grams of water | 30 | 30 | 40 |
| Humidity | % | 6.2 | 5.8 | 5.5 |
| Flat Crush | lb/sq inch | 479 | 610 | 640 |
| Stack strength | Kg | 311 | 310 | 363 |

Mullen Burst Test: T810 om-98 is the procedure used to measure the bursting strength of singlewall and doublewall corrugated and solid fiberboard.
ECT Testing: T 839 pm-95 is the procedure used to determine the edgewise compressive strength, parallel to the flutes, of a short column of singlewall or doublewall fiberboard.
Cobb Testing: ISO 535: 1991(E) specifies a method of determining the water absorptiveness of corrugated fiberboard under standard conditions.

The results of the tests show that the flat crush resistance is improved by both the inventive coatings relative to the traditional paraffin coating. The stack strength is improved using the coating composition No. 2; while the stack strength provided by coating composition No. 1 is similar to that provided by the currently used paraffin coating, but the coating 1 has been applied to a slightly thinner walled fluting used, again showing the advantages of the present invention. Also the ECT test shows results similar to those of the Stack Strength test.

It is of course to be understood that some preferred embodiments of the invention have been included and described in this specification for illustration purposes, and that numerous changes may be made to those embodiments without departing from the spirit and scope of the invention, which is defined by the appended claims.

What is claimed is:

1. A water-resistant and strengthened repulpable corrugated cardboard, having plies comprised of at least one outer liner and a fluting with at least one side of one of such plies having a water resistant flexible film formed from an aqueous coating composition comprising from about 10 to 70 wt % of a water-soluble sodium silicate in the form of a colorless, odorless viscous aqueous liquid with a density between about 1.39-1.40 g/cm$^3$;

from about 10 to 50 wt % of an aqueous emulsion of paraffin wax containing about 40-60% solids; and from about 10 to 60 wt % of a styrene-butadiene latex resin emulsion.

2. A corrugated cardboard according to claim 1, wherein said water-soluble sodium silicate is $Na_2SiO_3.H_2O$.

3. A corrugated cardboard according to claim 2, wherein the plies comprise two outer liners and an intermediate fluting; said fluting having been first coated on at least one side with said composition and subsequently being attached to said outer liners by a starch-based adhesive.

4. A corrugated cardboard according to claim 2, wherein said paraffin wax emulsion is an aqueous emulsion of a natural paraffin wax.

5. A corrugated cardboard according to claim 4, wherein the amount of coating applied to a side of the fluting is about 3-25 grams/m$^2$.

6. A corrugated cardboard according to claim 4, wherein said coating composition comprises from about 30 to 40 wt % of the water-soluble $Na_2SiO_3.H_2O$;

from about 10 to 20 wt % of the styrene-butadiene latex resin emulsion; and from about 30 to 40 wt % of the aqueous emulsion of natural paraffin wax.

7. A packing box made of corrugated cardboard having the fluting thereof coated with the composition according to claim 4.

8. A method of enhancing the strength of corrugated cardboard while remaining repulpable and having plies comprised of at least one outer liner and a fluting, said method comprising forming a water resistant flexible film on at least on ply by coating at least one surface of at least one of the plies with an aqueous coating composition comprising:

from about 10 to 70 wt % of a water-soluble sodium silicate in the form of a colorless, odorless viscous aqueous liquid with a density between about 1.39-1.40 g/cm$^3$;

from about 10 to 50 wt % of an aqueous emulsion of paraffin wax containing about 40-60% solids; and from about 10 to 60 wt % of a styrene-butadiene latex resin emulsion.

9. A method according to claim 8, wherein the aqueous coating comprises:

from about 40 to 50 wt % of the water-soluble sodium silicate;

from about 10 to 40 wt % of the styrene-butadiene latex resin emulsion; and from about 10 to 40 wt % of the aqueous emulsion of paraffin wax.

10. A method according to claim 8, wherein said water-soluble sodium silicate is $Na_2SiO_3.H_2O$.

11. A method according to claim 10, wherein said paraffin wax emulsion is an aqueous emulsion of a natural paraffin wax.

12. A method according to claim 11, wherein the aqueous coating comprises:

from about 30 to 40 wt % of the water-soluble $Na_2SiO_3.H_2O$;

from about 10 to 20 wt % of the styrene-butadiene latex resin emulsion; and from about 30 to 40 wt % of the aqueous emulsion of natural paraffin wax.

13. A method according to claim 12, wherein the aqueous coating comprises:

from about 25 to 35 wt % of the water-soluble $Na_2SiO_3H_2O$;

from about 10 to 15 wt % of the styrene-butadiene latex resin emulsion; and from about 25 to 35 wt % of the aqueous emulsion of aqueous natural paraffin wax.

14. A corrugated cardboard according to claim 12, wherein the amount of coating applied to a side of the fluting is about 3-25 grams/m$^2$.

* * * * *